US005245789A

United States Patent [19]

Rees et al.

[11] Patent Number: 5,245,789

[45] Date of Patent: Sep. 21, 1993

[54] KNIFE SHARPENER

[75] Inventors: Spencer C. Rees, Sugar Grove; Daniel S. Pusateri, Des Plaines; Susan C. Melvin, Streamwood, all of Ill.

[73] Assignee: Wen Products, Inc., Chicago, Ill.

[21] Appl. No.: 887,847

[22] Filed: May 26, 1992

[51] Int. Cl.[5] ..... B24B 9/02

[52] U.S. Cl. ..... 51/80 BS; 51/80 R

[58] Field of Search ..... 51/80 R, 80 BS, 81 BS, 51/285

[56] References Cited

U.S. PATENT DOCUMENTS

| | | | |
|---|---|---|---|
| D. 165,523 | 12/1951 | Iannelli . | |
| 820,761 | 5/1906 | Boldt . | |
| 977,624 | 12/1910 | Guhl . | |
| 1,444,374 | 2/1923 | Ensign . | |
| 1,925,108 | 9/1933 | Nagy | 51/80 R |
| 2,707,852 | 5/1955 | Fillweber | 51/80 R |
| 2,865,141 | 12/1958 | Madl et al. | 51/80 R |
| 3,258,878 | 7/1966 | Clark | 51/80 R |
| 3,484,997 | 12/1969 | Allen | 51/80 R |
| 4,157,897 | 6/1979 | Keat | 51/295 |
| 4,558,540 | 12/1985 | Collins | 51/214 |
| 4,807,399 | 2/1989 | Friel | 51/109 BS |
| 5,005,319 | 4/1991 | Friel | 51/109 BS |
| 5,018,310 | 5/1991 | Fierus et al. | 51/80 BS |

*Primary Examiner*—Bruce M. Kisliuk
*Assistant Examiner*—Eileen Morgan
*Attorney, Agent, or Firm*—Hill, Steadman & Simpson

[57] ABSTRACT

A knife sharpener has a slotted casing for housing grinding wheels made up of modular elements placed in back-to-back relation to form an assembly interfitting with a second assembly. The two assemblies rotate in opposite directions for peripheral grinding. Plastic gears adhesively fastened to the wheels interconnect a high speed universal motor to the grinding wheels to effect a 3.55 speed reduction. Simultaneous hollow grinding is effected with a burr free edge.

5 Claims, 2 Drawing Sheets

KNIFE SHARPENER

BACKGROUND OF THE INVENTION

1. Field of the Invention

This invention relates generally to improvements in the art of abrading and polishing and more particularly relates to an electric motorized knife sharpener.

2. Description of the Prior Art

Guhl U.S. Ser. No. 977,624 has two rows of grinding disks between which a knife blade may be inserted for sharpening. A somewhat similar arrangement is disclosed in Ensign U.S. Pat. No. 1,444,374. Fillweber U.S. Pat. No. 2,707,852 drives abrasive wheels through a gear train including worms and gears. Keat U.S. Pat. No. 4,157,897 shows a ceramic bonded grinding tool with graphite in the bond.

SUMMARY OF THE INVENTION

Two sets of counter-rotating wheels overlap each other and form a V-shaped included angle of approximately 40 degrees. The wheels are made up as modular assemblies wherein the hubbed wheel units are placed back-to-back and interfitted with one another.

A gear case is provided including plastic gears connected to shaft elements and reducing the speed of an approximately 20,000 r.p.m. universal motor down about 3.55 to 1 so that the grinding wheels can be rotated at about 4 to 5,000 r.p.m. The grinding wheels are made of aluminum oxide impregnated with diamond dust or other grit so that peripheral grinding is afforded for simultaneous hollow grinding of both sides of the cutting edge of a knife. A burr free cutting edge is produced.

DESCRIPTION OF THE PREFERRED EMBODIMENTS

Figure 1:
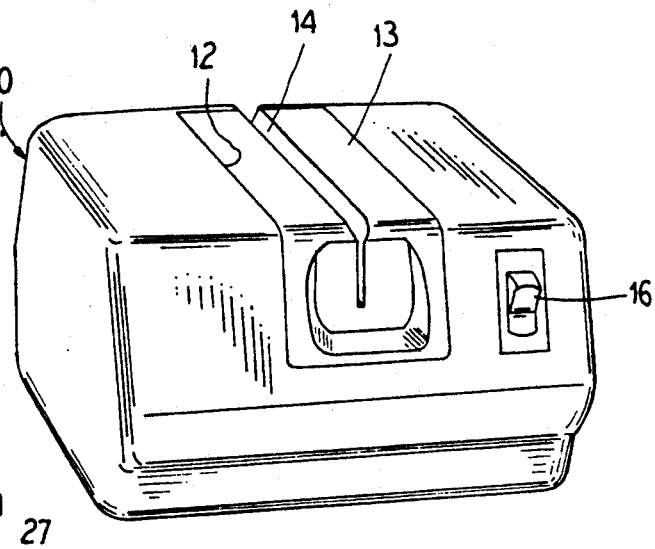
FIG. 1 is an isometric view of a knife sharpener embodying the principles of the present invention.

The principles of the present invention can be embodied in abrading instruments of different end uses. For example, essentially the same structural and functional features could be incorporated in a portable battery powered design of a knife and tool sharpener having particular utility for sportsmen and other users in the field. However, by way of exemplification of the principles of the present invention, the illustrative embodiment set forth in the attached drawings and described in the accompanying specification constitutes a domestic appliance of the type used by households in the kitchen as a counter-top article.

A stream-lined casing is attractively constructed of white or colored plastic or can be formed of metal to provide a housing for a knife sharpener identified generally at 10. In order to accommodate the display of the appliance on the kitchen counter in a permanent or semi-permanent manner, the casing is mounted on a plurality of rubber suction cups 11. In the embodiment shown in the drawings, the housing is made of plastic and the hollow interior is divided into a gear box compartment and a grinding wheel compartment.

The top wall of the housing has an elongated opening formed therein as at 12 in which is mounted and retained a member formed as a separate piece 13 so that it can be formed from a different material, in this instance, such as plastic, and so that it can form an access slot 14 through which the knife edge of a knife to be sharpened in the appliance 10 may be inserted and drawn.

The housing also carries at an accessible location on the front panel of the appliance 10 a control switch 16 by means of which the appliance may be actuated between off and on positions.

In accordance with the principles of the present invention, two sets of counter-rotating wheels are disposed and spaced with respect to one another that the outside diameters overlap. By virtue of such arrangement, the overlapping wheels form a V-shaped included angle of approximately forty (40) degrees (see FIG. 6) wherein the included angle is shown at 17.

Figure 5:
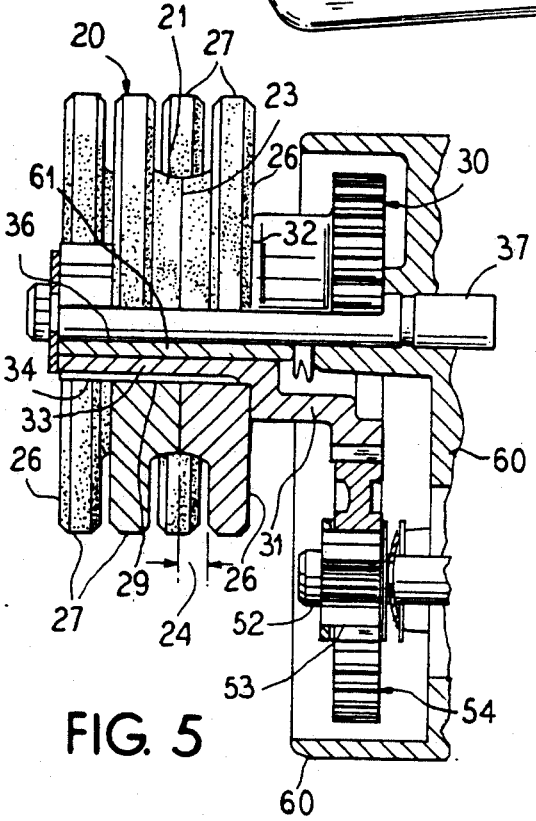
FIG. 5 is an enlarged fragmentary view of the grinding wheel assemblies and the connection therewith of the gear train.
Figure 3:
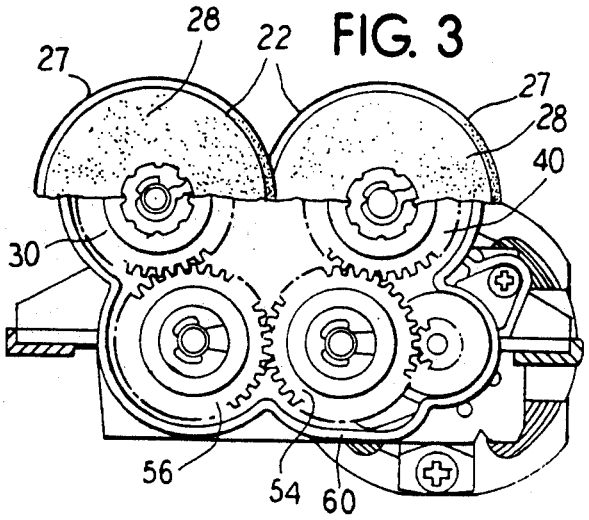
FIG. 3 is a partial cross-sectional view taken in the plane of line III—III of FIG. 2 with parts shown in elevation and showing additional details of construction of the grinding wheel assemblies and of the gear train arrangement of the present invention.
Figure 2:
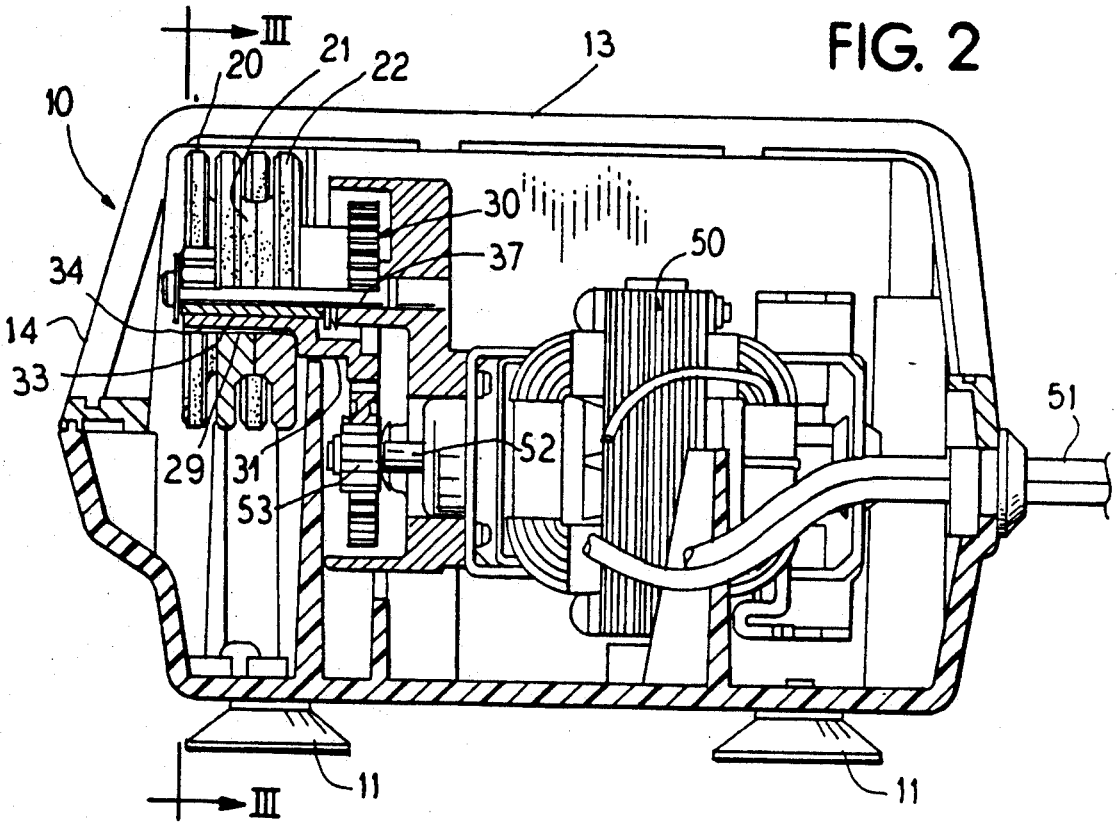
FIG. 2 is a cross-sectional view with parts shown in elevation and is taken generally in the plane of the access slot of the knife sharpener.

The grinding wheels, or rather the sets of grinding wheels, are made as a modular assembly. Referring to FIGS. 2 and 5, it will be noted that each wheel unit is identified at 20 and comprises a hub component 21 and a disc component 22.

Each hub component 21 has a flat radial face 23 adapted to abut in back-to-back adjacency with the hub component of a second corresponding wheel unit to thus provide a matched set of dual rotors for unison rotation in the same direction.

Moreover, each hub component 21 has a longitudinal extent indicated by the reference numeral 24 (FIG. 5) which is sized and adapted to accommodate a precise interfit with two other wheel units thereby to constitute a matched set of dual rotors with each respective set rotating in an opposite direction.

Each disc component 22 has a flat radial face 26 which facilitates stacking the wheel units on a shaft and making the units co-rotatable with the shaft and/or the gear with which the shaft is associated.

In one form of the invention, the wheel units are fabricated from aluminum oxide impregnated with a prescribed percentile quantity of diamond dust or other form of acceptable grit material. Thus, each disc component forms an abrading surface 27 on its outer periphery and an abrading surface 28 on the exposed portions of the flat radial face 26.

Referring further to the drawings, it will be noted that there is provided in accordance with the present invention a unique gear train made of plastic gears and their associated shaft elements.

A gear element is shown at 30 having a circumferential row of gear teeth of a selected size and number. The element 30 has a spacer hub 31 which provides a shoulder 32 against which one of the wheel units 20 may be bottomed. A shaft component 33 extends axially and longitudinally away from the spacer hub 31 and has formed in the peripheral surface thereof a plurality of longitudinally extending grooves 34, thereby providing a fluted surface on which is adhesively secured the hub portions 21 of the wheel units 20.

Figure 4:
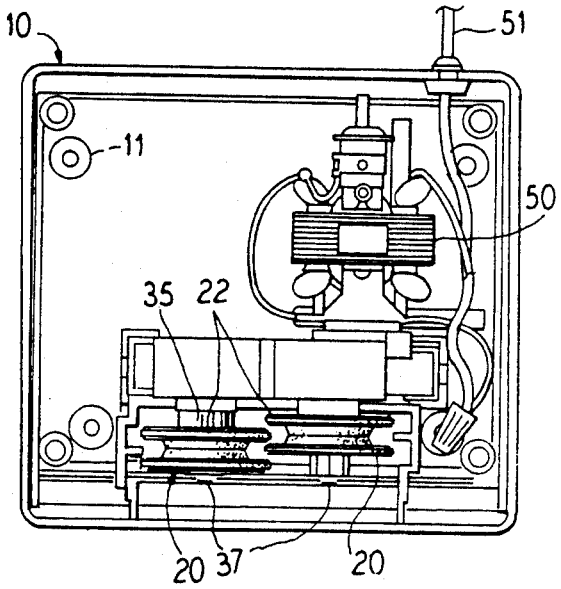
FIG. 4 is a top plan view or a cutaway view showing additional details of the structure of FIGS. 2 and 3.

A second gear element is shown at 40 and corresponds generally to the gear element 30. As shown on FIG. 4, there is a wheel spacer 35 which is used with the wheel set 30 but not with the wheel set 40. Each of the gear elements 30 and 40 is associated with a different set of wheel units 20,20 so that the wheel units 20 are longitudinally aligned with their hub components 21 abutting to provide an interfitting relationship between the disc components 22 of the wheel units, as is most clearly shown in FIG. 4, where it will be noted that the wheel spacer 35 allows the disc component 22 of one set of wheel units 20 to conveniently fit between the disc units 22,22 of the other set of wheel units.

In order to drive the gear train and the grinding wheels, there is provided an electric drive motor means. In accordance with this invention, the motor means is a universal motor designed to rotate or spin at a rate of approximately twenty thousand (20,000) revolutions per minute (r.p.m.). The motor is shown at 50 and is energized through the usual domestic supply through a conductor wire 51 under the control of the control switch 16.

The motor 50 drives the drive shaft 52, which, in turn, is connected to a pinion gear 53 in driving mesh with an intermediate gear 54. The gear 54 meshes with the gear element 40 and with a second intermediate gear 56. The second gear 56 meshes with the gear element 30. Therefore, the two wheel units driven respectively by the gears 30 and 40 will rotate in opposite directions.

The selection of the size and number of gear teeth of the components of the gear train is designed to afford a speed reduction of approximately 3.55 to 1. Thus, the grinding wheels will spin at a rotational speed of approximately four to five thousand r.p.m. (4 to 5,000 r.p.m.).

In this connection, it should be noted that the hub portions 21 are provided with axial longitudinally extending through openings 29. The inner diameter of a bronze bushing is shown at 36 and through which extends an axle or gear shaft 37. The grinding wheels 20 are adhesively connected to the gears 30/40, i.e., to the shaft component 33. A bronze bearing 61 is press fitted into the I.D. of the gear shaft component 33. The gear shaft 37 is press fitted into a zinc die cast gear case 60.

It will be understood that other parts and elements not numbered and not otherwise referred to or identified will be provided, for example, elements such as washers, load springs and snap rings, etc., to complete the assembly and which are understood by persons in the art as supplied where needed.

Figure 6:
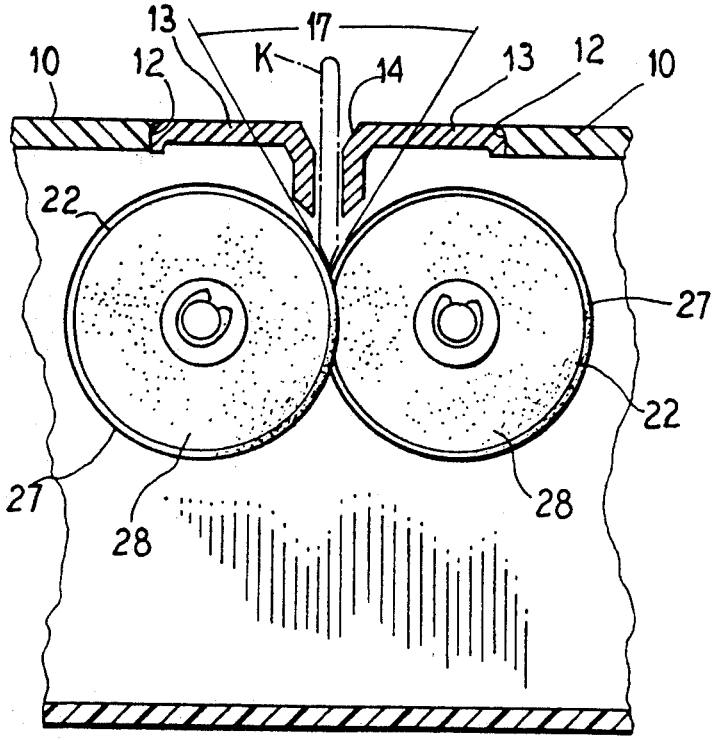
FIG. 6 is a fragmentary cross-sectional view showing the alignment of the grinding wheel assemblies with the access slot of the casing.

The wheel units are in registry with the access slot 14 and the oppositely rotating wheels form a V-shape for receiving the edge of a knife K shown in shadow lines in FIG. 6. As the grinding wheels rotate in counter rotating direction, the operator draws the knife K blade through the slot 14 with the edge of the blade in engagement with the grinding wheels at the V-shape thereby producing a continuous grinding action as the entire cutting edge of the blade is drawn lengthwise in one direction through the slot 14 and across the grinding wheels. Thus, the knife K is sharpened by peripheral sharpening action of the wheel discs and both sides of the knife edge are hollow ground simultaneously. Since the wheels are counter-rotating, heat is carried away from the edge being sharpened, thereby preserving the temper of the metal blade. Moreover a relatively burr free edge is produced.

Although minor modifications might be suggested by those versed in the art, it should be understood that we wish to embody within the scope of the patent warranted hereon all such modifications as reasonably and properly come within the scope of our contribution to the art.

We claim as my invention:

1. A sharpener comprising, a casing having walls dividing the interior into thereof into a gear box compartment and a grinding wheel compartment;

a universal electric motor in said casing, said motor being constructed and wired to rotate at a spinning speed of approximately twenty thousand revolutions per minute (20,000 r.p.m.);

two sets of counter-rotating wheels disposed and spaced within said grinding wheel compartment of said casing so that the outside diameter of the wheels overlap one another;

shaft members in said gear box compartment and being press fit in said walls of said casing forming said gear case compartment and said gear box compartment;

each of said wheels having gear shaft components including gears adhesively connected to said wheels and intermeshing with one another and said motor being connected in driving relation with said gears in such a manner as to effect a reduction between said motor and said wheels of approximately 3.55 to 1;

a bearing press fit into the gear shaft component of each wheel and each said bearing being rotatably journalled on a corresponding one of said shaft members thereby so that said motor drives the wheels in a range of rotational speed of about 4 to 5,000 r.p.m., said wheels being made of aluminum oxide and having embodied therein diamond dust to form a gritted grinding surface, said casing having an access slot in register with the overlapping wheels through which an edge of an article being sharpened may be drawn lengthwise across and in engagement with said gritted grinding surface for simultaneously hollow grinding both sides of said edge of said article.

2. A sharpener as defined in claim 1 wherein the outside diameter of said two sets of wheels overlap each other and form a V-shaped included angle of approximately forty degrees;

thereby allowing both sides of said edge drawn lengthwise across said wheels to be hollow ground precisely and simultaneously, while drawing heat away from said edge and producing a relatively burr-free edge.

3. A sharpener as defined in claim 1 where said two sets of counter-rotating wheels comprise grinding wheels made as a modular assembly comprising, two wheel units and each wheel unit having a hub component and a disc component, said hub component having a flat radial surface adapted to abut in back-to-back adjacency with the hub component of a second wheel unit to thus provide a matched set of dual rotors for unison rotation in the same direction, said hub component having a longitudinal extent sized and adapted to accommodate a precise interfit with two other wheel units constituting a matched set of dual rotors rotating in an opposite direction;

each hub component being provided with an axial longitudinally extending through opening;

a bronze bushing for each hub component and forming a bearing journal surface and being press fit into the corresponding one of said through openings of said hub components;

a shaft member for each set of wheel units and being press fit into said walls of said casing, said bronze bushings being journalled on said shaft members for rotatably mounting said wheel units in said casing;

whereby the periphery of the wheel units can be utilized for sharpening operations by drawing an edge of an article to be sharpened in a lengthwise direction across the disc components as they rotate.

4. In a sharpener as defined in claim 3, at least two of such assemblies mounted in overlapping and interfitted relation so that the wheel peripheries form a V-shaped included angle of approximately forty degrees;

thereby to simultaneously hollow grind both sides of said edge as said article is drawn lengthwise through the V-shaped angle.

5. In a sharpener as defined in claim 4, said universal electric motor driving said wheel assemblies in counter-rotating directions;

thereby drawing heat away from said edge of said article being sharpened and preserving the temper of said edge.

* * * * *